US010141635B2

(12) United States Patent
Leung et al.

(10) Patent No.: US 10,141,635 B2
(45) Date of Patent: Nov. 27, 2018

(54) SYSTEMS, APPARATUS, AND METHODS TO OPTIMIZE ANTENNA PERFORMANCE

(71) Applicant: Antwave Technology Limited, Hong Kong (HK)

(72) Inventors: Chun Kai Leung, Hong Kong (HK); Chi Sun Yu, Hong Kong (HK)

(73) Assignee: ANTWAVE TECHNOLOGY LIMITED, Hong Kong (HK)

( * ) Notice: Subject to any disclaimer, the term of this patent is extended or adjusted under 35 U.S.C. 154(b) by 0 days.

(21) Appl. No.: 15/808,935

(22) Filed: Nov. 10, 2017

(65) Prior Publication Data

US 2018/0138584 A1 May 17, 2018

Related U.S. Application Data

(60) Provisional application No. 62/421,992, filed on Nov. 14, 2016.

(51) Int. Cl.

| | |
|---|---|
| ***H01Q 1/12*** | (2006.01) |
| ***H01Q 1/27*** | (2006.01) |
| ***H01Q 1/22*** | (2006.01) |
| ***H01Q 9/26*** | (2006.01) |

(52) U.S. Cl.
CPC ..... *H01Q 1/273* (2013.01); *H01Q 1/2291* (2013.01); *H01Q 9/26* (2013.01)

(58) Field of Classification Search
CPC ..... H01Q 1/273; H01Q 1/2291; H01Q 9/26
See application file for complete search history.

(56) References Cited

U.S. PATENT DOCUMENTS 5,339,089 A * 8/1994 Dienes ..... H01Q 1/38 343/700 MS
6,483,471 B1 * 11/2002 Petros ..... H01Q 9/16 343/725

OTHER PUBLICATIONS

X. H. Jin et al., Super-Wideband Printed Asymmetrical Dipole Antenna, Progress in Electromagnetics Research Letters, 2011, p. 117-123, vol. 27.

(Continued)

*Primary Examiner* — Graham Smith

(57) ABSTRACT

Disclosed are a system, apparatus, and method for modifying a dipole antenna to comprise unequal arm lengths for matching the condition of two different dielectric materials such as air and human body. The modified dipole antenna is built in a cylindrical pipe shape dipole that has a hollow center to let wires pass through it and has little to no effect in antenna performance The antenna can be bent in different shape to fit in any wireless product of any shape or size. The antenna is designed to provide a stable radiation at one side and partial radiation at front side even with human body intervention. Further the antenna can be combined with another similar antenna via a power splitter/divider to form a full 360 degree radiation pattern even in presence of a human body in proximity.

19 Claims, 26 Drawing Sheets

(56) References Cited

OTHER PUBLICATIONS

Chung-Hsiu Chiu et al., Compact Dual-Band Dipole Antenna with Asymmetric Arms for WLAN Applications, Hindawi Publishing Corporation International Journal of Antennas and Propagation, Mar. 17, 2014, p. 1-4, vol. 2014, Article ID 195749.
Mark E. Vickberg et al., Design Considerations for Indoor Wireless Transmission between a Body-Worn Physiological Monitoring Device and a Gateway in a Home Environment, American Journal of Biomedical Engineering, Jun. 2016, p. 95-114, 6(4).
R. Poonkuzhali et al., Miniaturized Wearable Fractal Antenna for Military Applications at VHF Band, Progress in Electromagnetics Research C, 2016, p. 179-190, vol. 62.

* cited by examiner

1300

1600

| Substance | $\epsilon_r$ |
|---|---|
| Blood | 59.37 |
| Bones | 11.780 |
| Muscle | 59.372 |
| Skin | 38.871 |

Figure 16

2402

| | Chip Antenna | PIFA | Patch Antenna | Dipole | Proposed Antenna |
|---|---|---|---|---|---|
| Component matching needed | ● | | | | |
| Large ground plane | ● | ● | ● | | |
| Affected by human body | ● | ● | | ● | |
| 360 degree field pattern | ◆ | ◆ | | ◆ | ◆ |
| Able to mount wires | | | | | ◆ |
| Bend-able to fit product | | | | ◆ | ◆ |

● bad

◆ good

Figure 24

SYSTEMS, APPARATUS, AND METHODS TO OPTIMIZE ANTENNA PERFORMANCE

TECHNICAL FIELD

The disclosed subject matter relates to a system and method to optimize antenna performance for various applications, more particularly the disclosed subject matter relates to system and method to reduce radiation influence in antenna.

BACKGROUND

Nowadays, many types of antenna (such as PIFA, chip antenna, etc) are available in the industry of wireless products. However, as technologies like wearable devices, IOTs, RFID, etc become popular in the market, size of consumer products also decreased considerably and proximity to the human body increased considerably. Therefore, the general types of available antenna in market are no more suitable for consumer products as the room for antenna is not enough in small devices since most of the antennas need a large ground plane. Also, as wireless products are attached very close to the human body, performance of the antenna gets significantly affected.

For example, hearing aids are very small and delicate devices and comprise many electronic and metallic components contained in a housing small enough to fit in the ear canal of a human or behind the outer ear. The various electronic and metallic components impose high design constraints on radio frequency antennas without disrupting the resulting radiation pattern.

Therefore, there exists a need for developing a small sized antenna capable enough to reduce the influence of human body (or any other external factors) on the radiation pattern.

SUMMARY

This summary is provided to introduce concepts related to system and method for prioritizing and scheduling notifications to a user on user's device and the concepts are further described in the detailed description. This summary is not intended to identify essential features of the claimed subject matter nor is it intended for use in determining or limiting the scope of the claimed subject matter.

In an implementation, a modified dipole antenna is disclosed comprising a first arm having its surface layer made of a metal and its inner layer made of a non-metal, wherein a feed of a radio frequency signal cable is attached to its surface layer. The antenna further comprises a second arm having its surface layer made of a metal and inner layer made of a non-metal, wherein a radio frequency signal cable is passed through its inner layer and ground is attached to its surface layer. In another implementation, the antenna may be completely made up of a different substrate like flexible PCB etc. Further, length of the first arm is determined from a first dielectric constant of a first dielectric material and length of the second arm is determined from a second dielectric constant of a second dielectric material. In an embodiment, the first dielectric material is air and the second dielectric material is human body. Further, in an embodiment, the modified dipole antenna is bendable. Further, in an embodiment, the modified dipole antenna is fitted into a cylindrical pipe shape that is bendable for fitting into a wireless electronic apparatus. Further, in an embodiment, the wireless electronic apparatus is a headset worn by a human body. Further, in an embodiment, the first and second dielectric constants are different.

Further, in an embodiment, a wireless transceiver operated frequency is determined by ratio of the lengths of the first arm and the second arm. Further, in an embodiment, the wireless transceiver operated frequency is dependent on the first dielectric constant, the second dielectric constant, and width of the modified dipole antenna that is fitted into a cylindrical shape body. Further, in an embodiment, the length of the first arm is tuned as per dielectric constant of air. Further, in an embodiment, the length of the first arm is 3 cm for quarter wavelength dipole and 6 cm for half wavelength dipole operating at 2.4 GHz. Further, in an embodiment, the length of the second arm is tuned according to dielectric constant of human body. Further, in an embodiment, the lengths of the first and second arms are differently tuned for widening bandwidth of the modified dipole antenna to further minimize radiation disturbance caused by presence of a human body. Further, in an embodiment, the first and the second arms are hollow for allowing signal wires to pass through along diameter. Further, in an embodiment, width of at least one of the first arm and the second arm is comparatively thinner than the other. Further, in an embodiment, the first and the second arms are designed to be detachable from the modified dipole antenna.

Further, in an embodiment, the modified dipole antenna is combined together with a power divider, wherein the power divider is further connected with a second modified dipole antenna for enhancing collaborative performance. Further, in an embodiment, the second modified dipole antenna is similar to the modified dipole antenna and comprises symmetric arm lengths. Further, in an embodiment, the second modified dipole antenna is similar to the modified dipole antenna and comprises asymmetric arm lengths. Further, in an embodiment, partial radiation patterns of the modified dipole antenna and the second modified dipole antenna are combined to provide a full 360 degree radiation pattern. Further, in an embodiment, partial radiation patterns of the modified dipole antenna and the second modified dipole antenna minimizes signal attenuation caused due to presence of a human body in proximity. Further, in an embodiment, the first arm and the second arm is bent in a spiral shape forming different radii of the first arm and the second arm. Further, in an embodiment, the radii of the first arm and the second arm are dependent on resonance frequencies of the wireless transceiver. Further, in an embodiment, the modified dipole antenna is fitted into a wireless ear bud that is pluggable inside human ear. Further, in an embodiment, the modified dipole antenna is a half-wavelength dipole antenna. Further, in an embodiment, the modified dipole antenna is a quarter-wavelength dipole antenna.

Other and further aspects and features of the disclosure will be evident from reading the following detailed description of the embodiments, which are intended to illustrate, not limit, the present disclosure.

BRIEF DESCRIPTION OF THE DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and processes that are consistent with the subject matter as claimed herein.

FIG. 16 illustrates various dielectric constant values of human body in a tabular form, in accordance with an aspect of the embodiments;

FIG. 24 illustrates a comparison chart comparing advantages of the modified dipole antenna over other traditional antennas, in accordance with an aspect of the embodiments.

DESCRIPTION

A few inventive aspects of the disclosed embodiments are explained in detail below with reference to the various figures. Embodiments are described to illustrate the disclosed subject matter, not to limit its scope, which is defined by the claims. Those of ordinary skill in the art will recognize a number of equivalent variations of the various features provided in the description that follows.

Reference throughout the specification to "various embodiments," "some embodiments," "one embodiment," or "an embodiment" means that a particular feature, structure, or characteristic described in connection with the embodiment is included in at least one embodiment. Thus, appearances of the phrases "in various embodiments," "in some embodiments," "in one embodiment," or "in an embodiment" in places throughout the specification are not necessarily all referring to the same embodiment. Furthermore, the particular features, structures or characteristics may be combined in any suitable manner in one or more embodiments.

Figure 1:
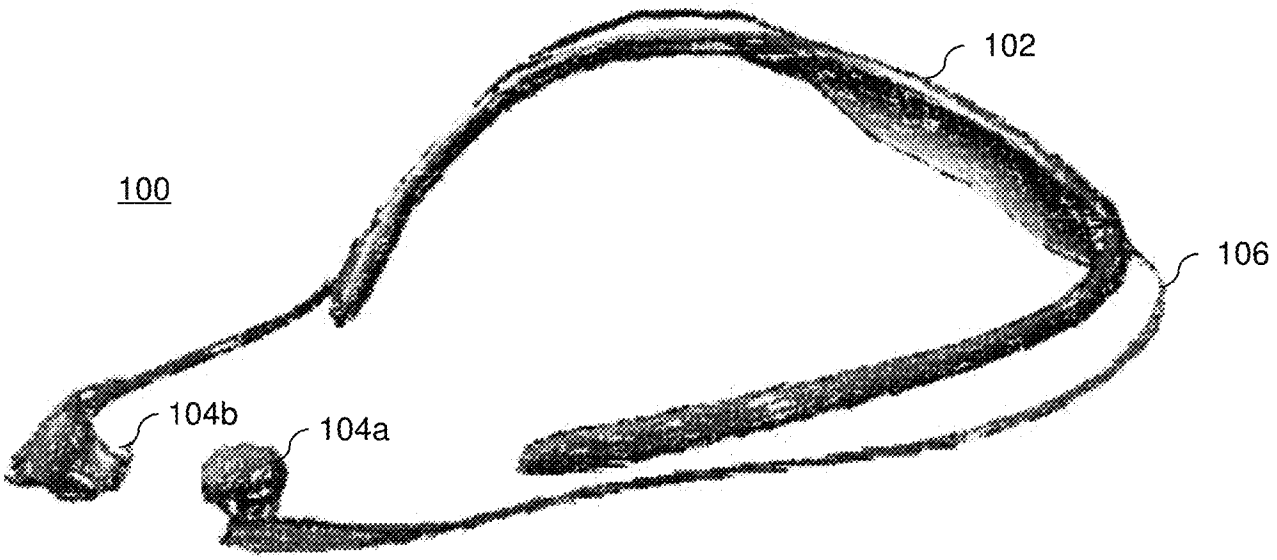
FIG. 1 illustrates a wireless headset having an antenna therein, in accordance with aspects of the embodiments.

FIG. 1 illustrates a wireless headset 100 having an antenna therein (not shown), in accordance with aspects of the embodiments. The wireless headset 100 comprises a human wearable headset body 102, human wearable ear-set (speakers) 104*a* and 104*b*, and a connecting wire 106 for connecting the ear-set 104*a-b* with the antenna hidden in the body 102. The antenna is, in one embodiment, used for receiving and transferring data wirelessly over a network. The network may be any of the wireless LAN, PAN, MAN, or WAN. Also, the network may use any short range communication technologies like Bluetooth, Wi-Fi, etc.

Further, the antenna is specifically designed to minimize radiation influence caused by a human body or by any other conducting or radiating materials like metals. This approach ensures quality reception and transmission of wireless data with minimal or no data loss. Also, the antenna is designed to be installed in any consumer electronics of any size or shape. The example of the headset 100 is selected for illustration purposes only.

Specifically, the antenna is proposed as a modified dipole antenna that is specially designed with unequal arm length to match the condition of two different dielectric materials (e.g., air and human body). Also, the antenna is designed with a pipe-shape dipole with a 'hollow at the center' to let wires pass through and have little or no effect in antenna performance This design overcomes the radiation issues created by decreasing sizes of antenna and wearable antenna devices.

Figure 2:
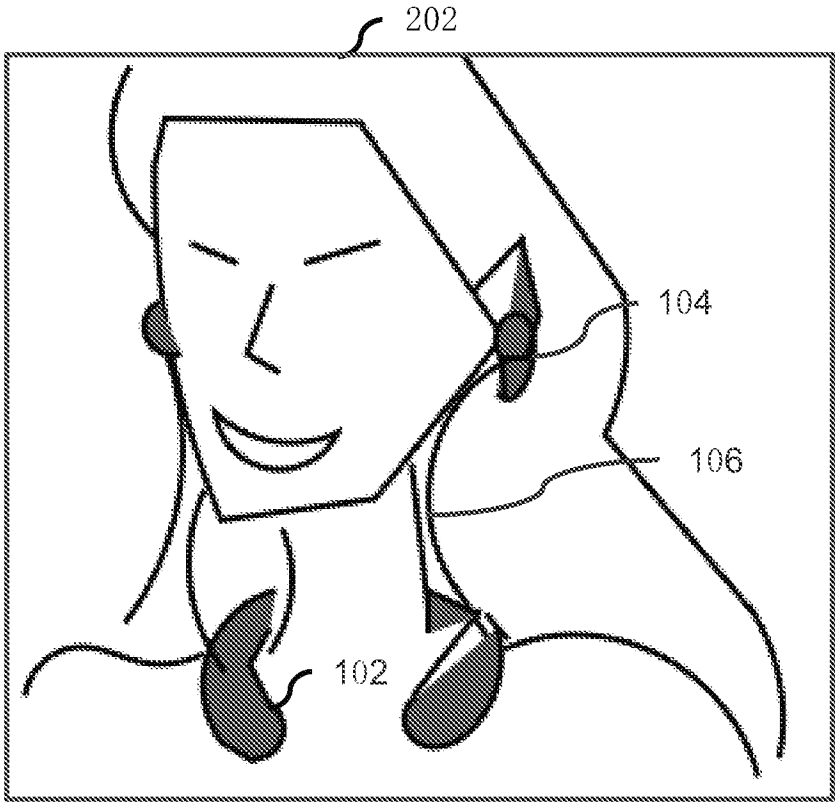
FIG. 2 illustrates a user wearing a headset comprising an antenna therein, in accordance with aspects of the embodiments.

FIG. 2 illustrates a user 202 wearing the headset 100 with ear plugs 104 plugged in ears and headset body 102 resting on shoulders/neck of the user 202. As evident from the figure, the antenna (not shown) within the headset body 102 is very near to the body of the user 202 and is hence prone to radiation deflection that can cause data loss during wireless communication. However, the structure of the proposed antenna is specifically designed to ensure effective wireless data transfer even when in contact with the human body or external factors. Also, the antenna can be mounted in very small devices such as an ear set 302, as illustrated in FIG. 3, shown plugged into an ear 304 of a user.

Figure 3:
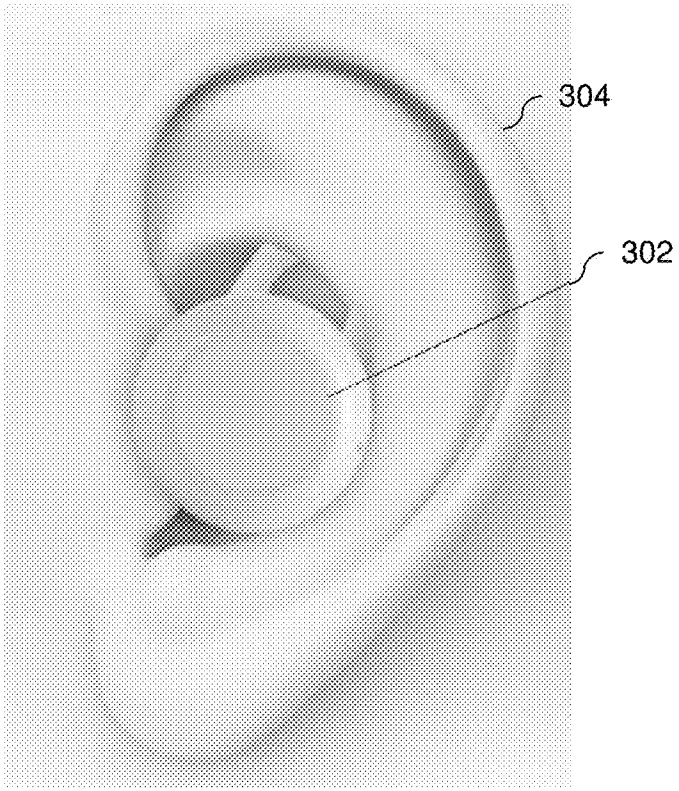
FIG. 3 illustrates a user wearing a ear set comprising an antenna therein, in accordance with aspects of the embodiments.
Figure 4:
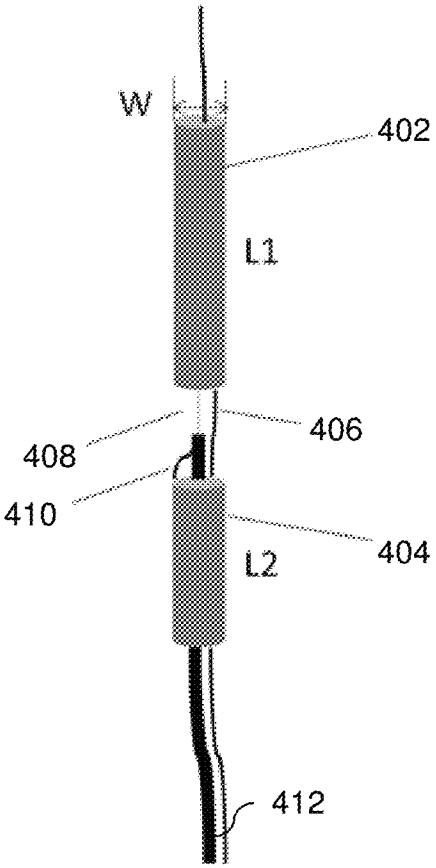
FIG. 4 illustrates a structure of a modified dipole antenna, in accordance with an aspect of the embodiments.
Figure 5B:
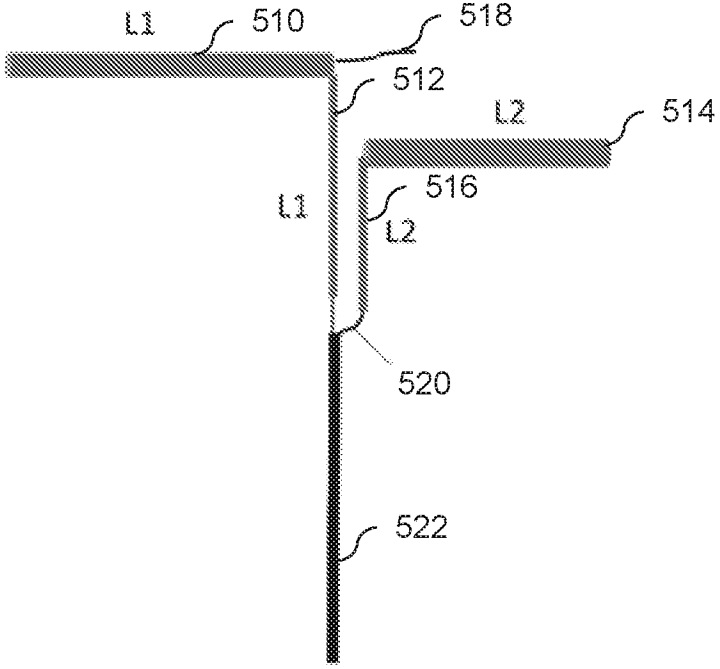
FIG. 5B illustrates a structure of a modified dipole antenna with four metal arms, in accordance with an aspect of the embodiments.

FIG. 4 illustrates a modified dipole antenna structure as discussed in conjunction with FIG. 1-3 of the present invention. The antenna comprises of two metal portions 402 and 404 with varied lengths 'L1' and 'L2' (arbitrary values) respectively and with common cylindrical width 'W' (arbitrary value). Further illustrated are signal wires 406, feed 408, GND 410, and a coaxial cable to wireless transceiver 412. The antenna is designed in a way to function between two mediums such as air and human body. Other possible shapes of the modified dipole antenna structure are illustrated in FIGS. 5A and 5B.

Figure 5A:
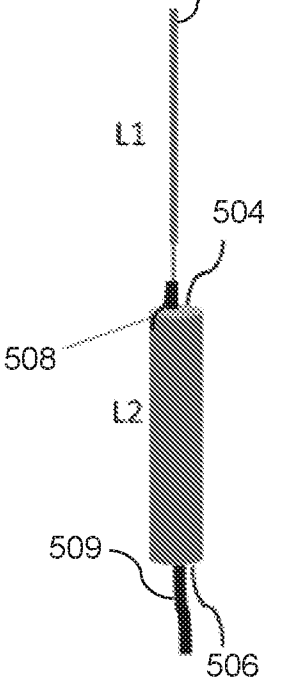
FIG. 5A illustrates a structure of a modified dipole antenna with two metal arms of varied lengths and widths, in accordance with an aspect of the embodiments.

FIG. 5A illustrates another antenna structure of a modified dipole antenna with two metal portions 502 and 504 with varied lengths 'L1' and 'L2' (arbitrary values) respectively and with different widths. Further displayed are signal wires 506, GND 508, and a coaxial cable to wireless transceiver 509. Similarly, FIG. 5B illustrates yet another antenna structure of a modified dipole antenna with four metal portions 510, 512, 514, and 516. The metal portions 510 and 512 have same lengths 'L1' (arbitrary values and not necessarily equal to the length shown in any other figures) and metal portions 514 and 516 have same lengths 'L2' (arbitrary values). However, as clearly illustrated, lengths of 510, 512 are different from the lengths of 514 and 516. Further displayed are signal wires 518, GND 520, and a coaxial cable to wireless transceiver 522.

Figure 6B:
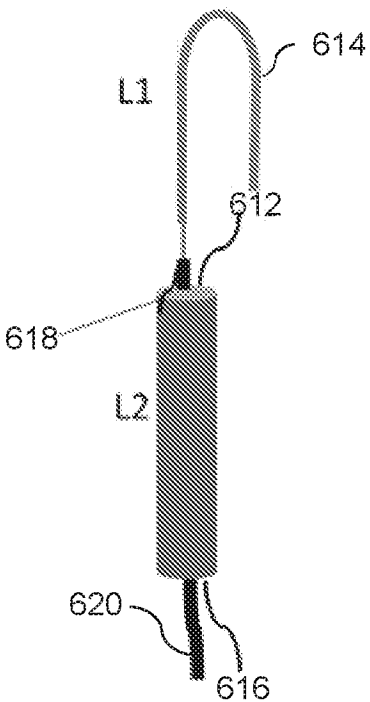
FIG. 6B illustrates a structure of a modified dipole antenna with a metal arm bent in a curve, in accordance with an aspect of the embodiments.
Figure 6A:
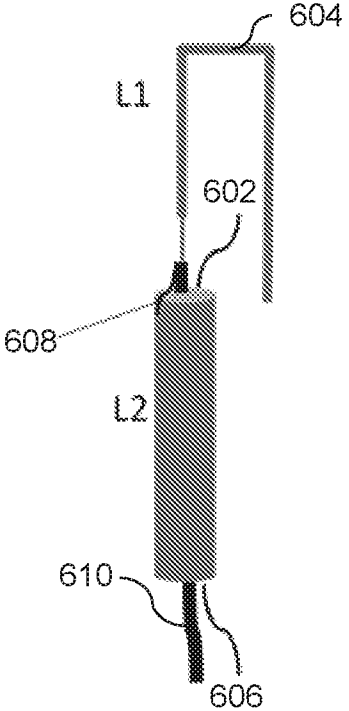
FIG. 6A illustrates a structure of a modified dipole antenna with a metal arm bent twice, in accordance with an aspect of the embodiments.

FIG. 6A illustrates further possible modifications in the antenna structure of modified dipole antenna (as illustrated in FIG. 5A). Specifically, FIG. 6A illustrates a bent antenna structure of a modified dipole antenna with two metal portions 602 and 604 with varied lengths 'L1' and 'L2' (arbitrary values) respectively and with different widths. Herein, the metal portion 604 is bent two times, as illustrated. Further displayed are signal wires 606, GND 608, and a coaxial cable to wireless transceiver 610.

Similarly, FIG. 6B illustrates further possible modifications in the antenna structure of modified dipole antenna (as illustrated in FIG. 5A). Specifically, FIG. 6B illustrates another type of bent antenna structure with two metal portions 612 and 614 with varied lengths 'L1' and 'L2' (arbitrary values) respectively and with different widths. Herein, the metal portion 614 is bent into a curve, as illustrated. Further displayed are signal wires 616, GND 618, and a coaxial cable to wireless transceiver 620.

The bent structure allows better installation and radiation acceptance within consumer electronics and also helps in minimizing size of consumer electronics. Further, the two types of bent structure illustrated are for illustration purposes only and are not meant for restricting the scope of the invention. The invention has a broader scope of covering all types of possible bents in the antenna structure by abiding to the spirit of the invention.

Figure 7:
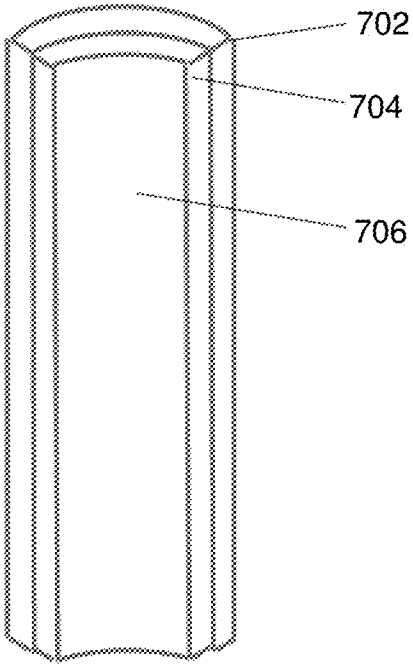
FIG. 7 illustrates a cross section of an antenna arm comprising an outer layer and an inner layer, in accordance with an aspect of the embodiments.

FIG. 7 illustrates a cross section of an antenna arm comprising an outer layer 702, an inner layer 704, and a core 706. The outer layer 702 may be made of a metal such as a copper. The inner layer 704 may be made of any other substrate such as, but not restricted to, air, plastic, etc. Further, the core 706 may provide space for wires to pass through and may be hollow filled with air.

Figure 8A:
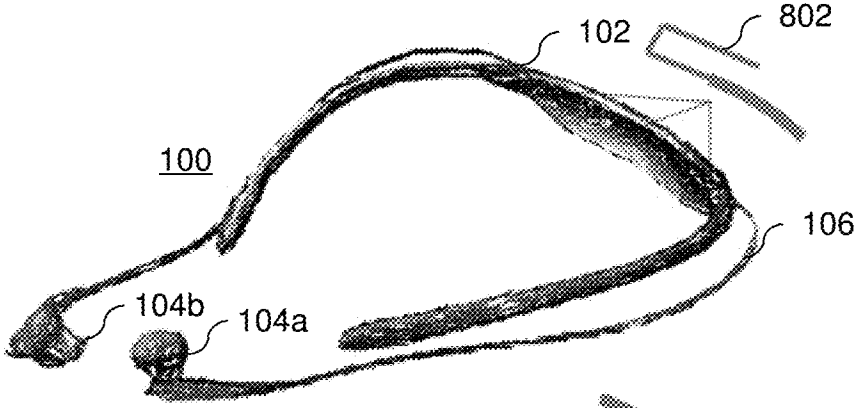
FIG. 8A illustrates a headset comprising a bent antenna, in accordance with an aspect of the embodiments.
Figure 8B:
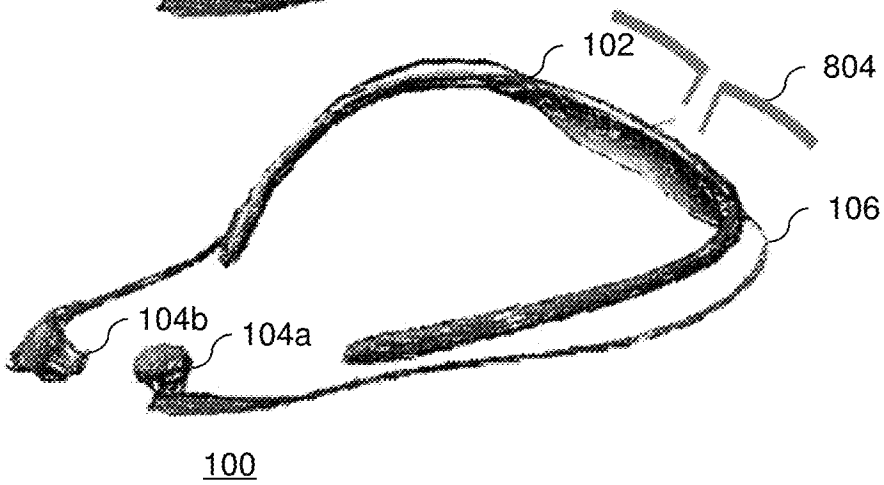
FIG. 8B illustrates a headset comprising another antenna structure, in accordance with an aspect of the embodiments.

FIG. 8A illustrates a headset (such as the headset 100 illustrated in FIG. 1) comprising the proposed antenna 802 with a bent structure as illustrated in FIG. 6A of the present invention. Similarly, FIG. 8B illustrates a headset (such as the headset 100 illustrated in FIG. 1) comprising the proposed antenna 804 with a bent structure as illustrated in FIG. 5B of the present invention. The illustrations of the FIGS. 8A and 8B are not meant for restricting the scope of the invention. The antenna is designed to bend in different shapes and directions by adhering to the spirit of the present invention.

Figure 9:
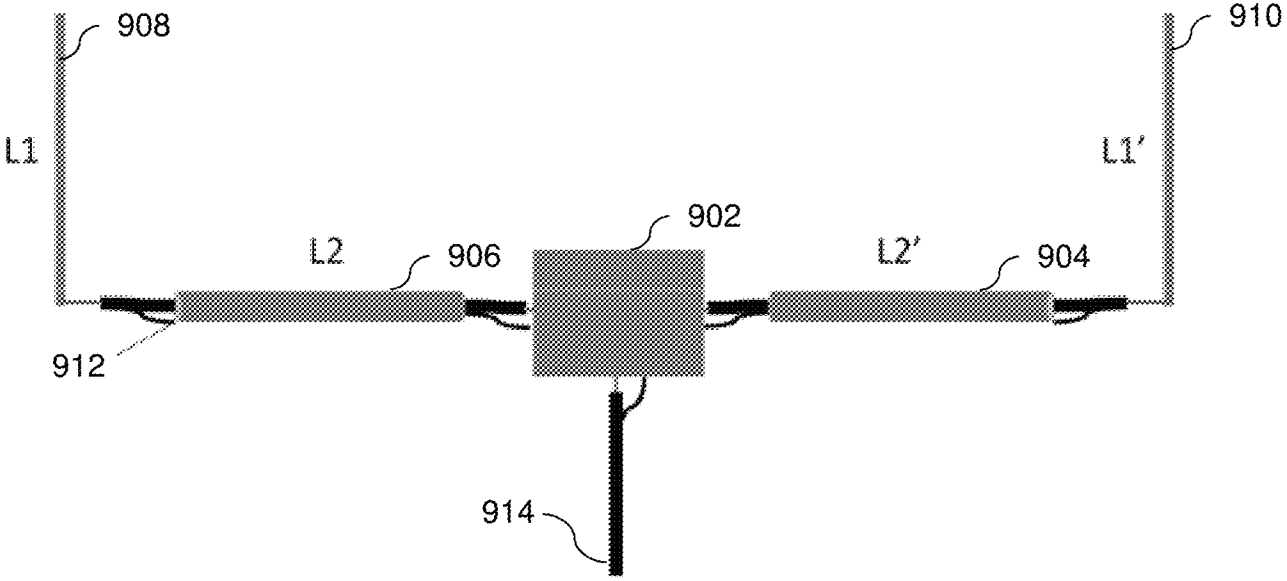
FIG. 9 illustrates a structure of a modified dipole antenna with a power divider, in accordance with an aspect of the embodiments.

FIG. 9 illustrates another antenna structure of a modified dipole antenna with a power divider/splitter/combiner 902 and with four metal portions 904, 906, 908, and 910. Basically, the illustrated antenna structure is built by combining two different antennas together and combined by the power splitter 902. The two antennas can be any of the antennas illustrated in conjunction with the FIGS. 1-8 of the present invention. Therefore, multiple combinations of the proposed antennas can be combined for better efficiency. Herein, all the four metal portions 904, 906, 908, and 910 have different lengths L2', L2, L1, L1' respectively (arbitrary values and not necessarily equal to the length shown in any other figures). Further displayed are GND 912 and a coaxial cable to wireless transceiver 914.

Figure 10:
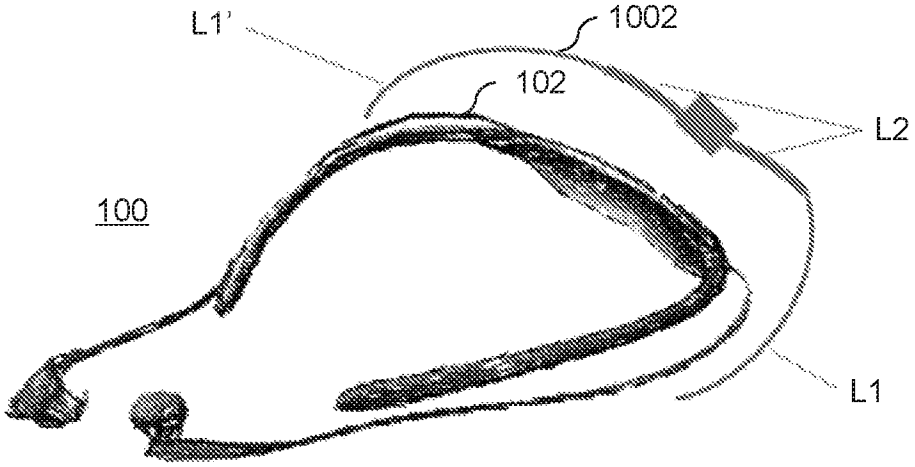
FIG. 10 illustrates a headset comprising a dual antenna structure, in accordance with an aspect of the embodiments.

FIG. 10 illustrates a headset (such as the headset 100) structure and a structure of the proposed antenna 1002 that can be installed inside the body 102 of the headset 100. The antenna structure illustrated here resembles with the one illustrated in the FIG. 9 of the present invention comprising a power divider with four metal portions and is illustrated here to show design compatibilities between the headset 100 and the antenna 1002. However, unlike the antenna described in FIG. 9 of the present invention where all metal arms had different lengths, the antenna 1002 has two metal arms of same length L2 (arbitrary value) and another two arms of different lengths L1 and L1' (arbitrary values). The arm lengths illustrated in the antenna 1002 are for illustrating various structural capabilities of the proposed antenna for being compatible with most of the small scale and human wearable wireless devices. Although, the proposed antenna is equally functional with any other consumer electronics with any shape, size, or purpose.

The overall wide length of antenna 1002 allows the antenna 1002 to get a better signal reception at all times and from all angles. Further, the different lengths and widths of the antenna metal arms allow the antenna 1002 to be fitted in any type of consumer electronics of any size and shape. Further, as shown, arm L1' fits into the arm of the wireless headset body 102 and therefore provides a stable radiation pattern at other side of neck and partial radiation at the front side of the neck. For better understanding, the headset 1002 can be viewed in conjunction with FIG. 2 of the present invention, where a user is illustrated wearing the headset.

Similarly, arm L2 is shown to be compatible for fitting into the back of the wireless headset 1002 to provide back-lobe and the arm L1 fits into the arm of the wireless headset 1002. Thereby, enabling a stable radiation pattern at one side of the neck and partial radiation at the front side of the neck. Further, the antenna can be bent in different shapes to fit the wireless product. Generally, the length of L1 and L1' is $\lambda g/4$—quarter wavelength in a dielectric constant substrate or space. However, their lengths can be extended (about $\lambda g/2$—half wavelength or $\lambda g/2 \pm l$ in a dielectric constant substrate or space, where l is the variable length of antenna arm). The extended length is used to increase the radiation signal in the front of neck due to the serious signal attenuation from antenna and neck.

Figure 11:
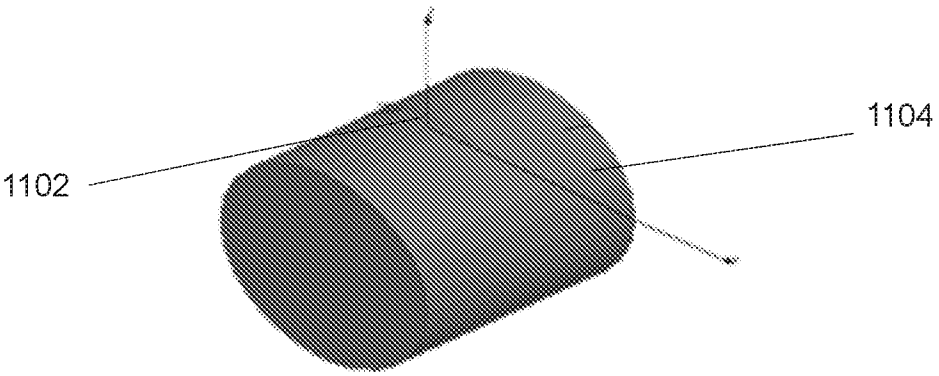
FIG. 11 illustrates simulation of proposed antenna around a high dielectric constant material, in accordance with an aspect of the embodiments.
Figure 12A:
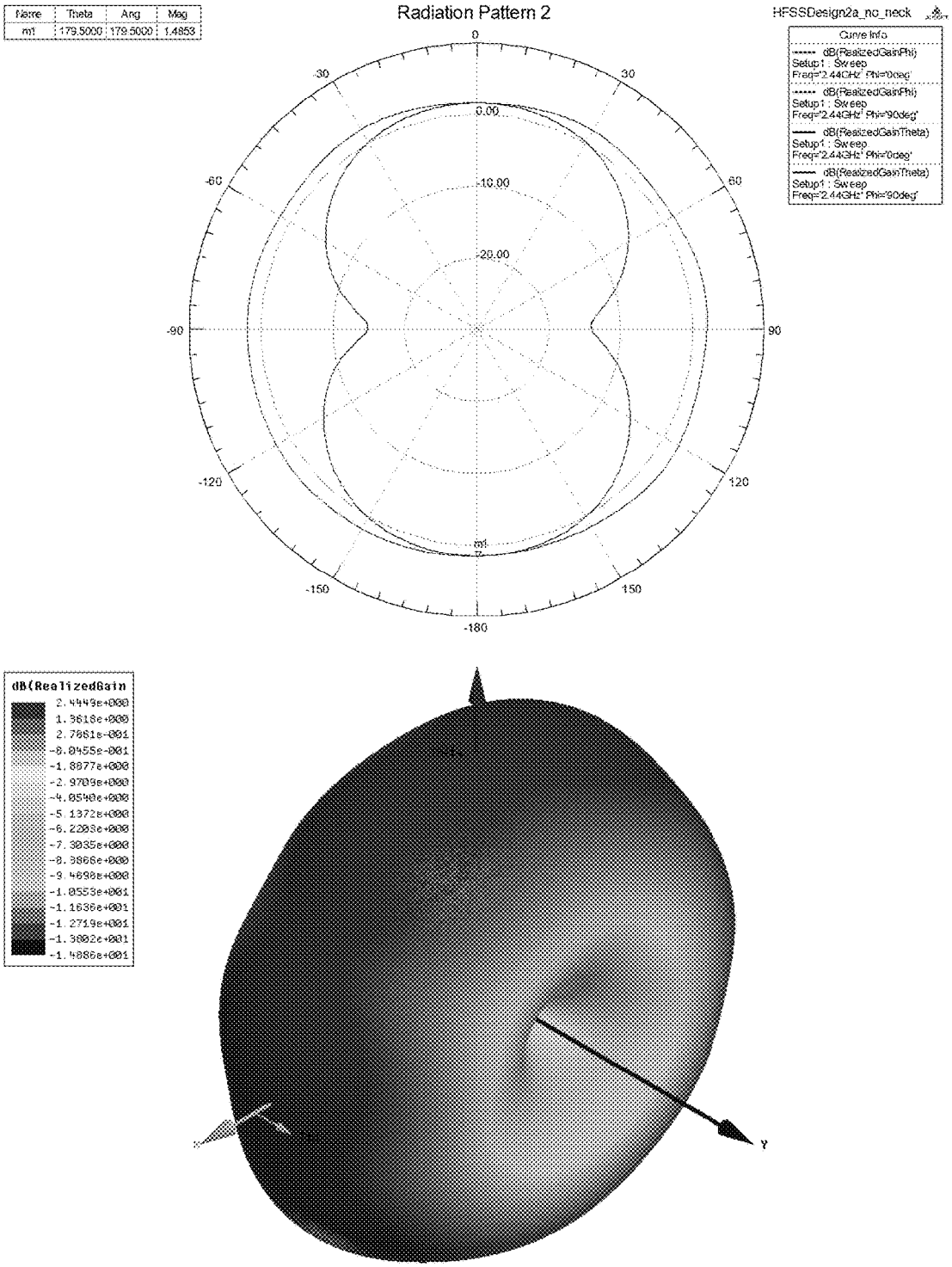
FIG. 12A-C illustrates simulation results of different dielectric constants, in accordance with an aspect of the embodiments.
Figure 12B:
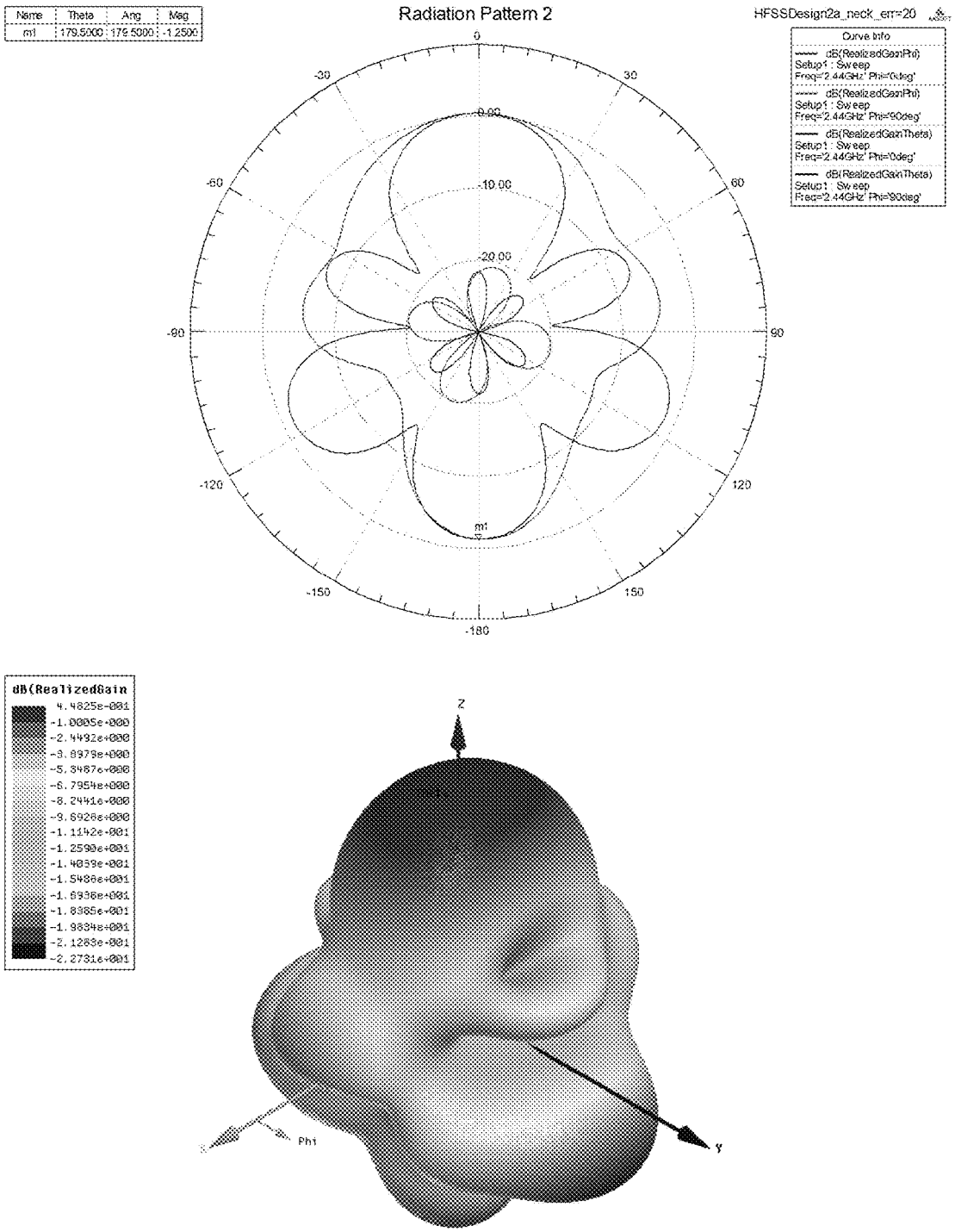
Figure 12C:
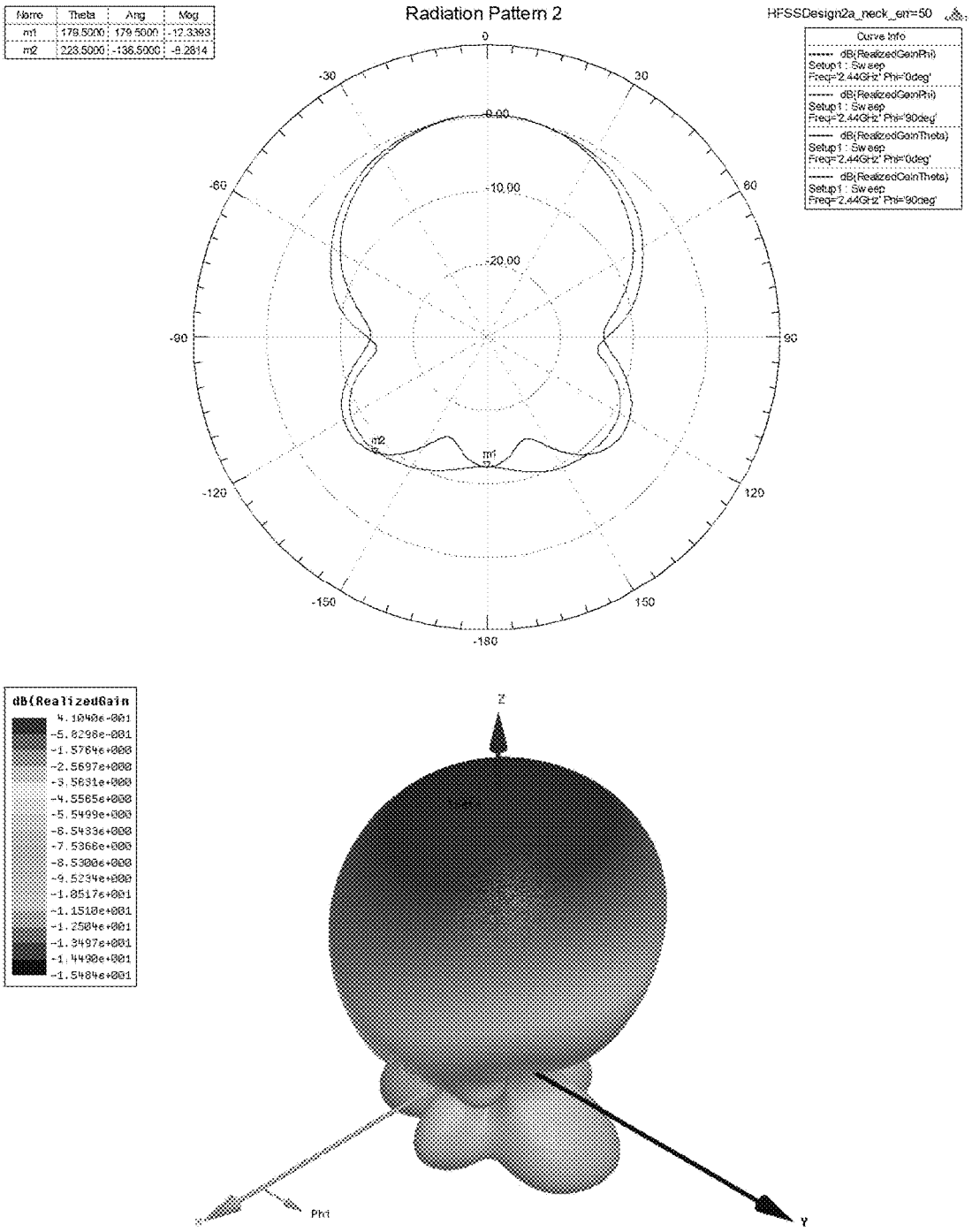

FIG. 11 illustrates simulation of proposed antenna 1102 around a high dielectric constant material 1104 (e.g., neck of a human) The simulation results of different dielectric constants are further illustrated in FIG. 12A-C of the present invention. FIG. 12A illustrates simulation results of the case where dielectric constant is 1. FIG. 12B illustrates simulation results of the case where dielectric constant is 20. FIG. 12C illustrates simulation results of the case where dielectric constant is 50.

Figure 13:
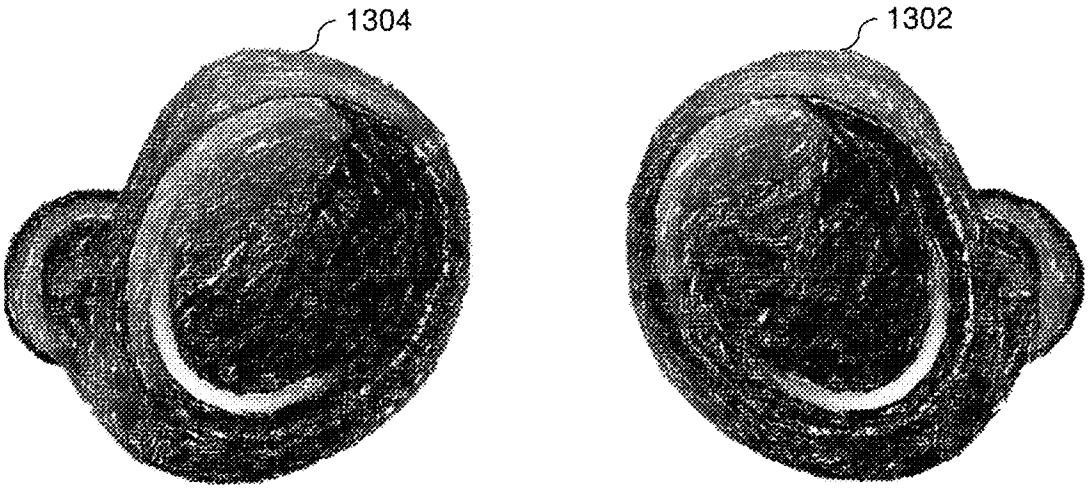
FIG. 13 illustrates an ear set fitted with a modified dipole antenna, in accordance with an aspect of the embodiments.

FIG. 13 illustrates a wireless ear set 1300 having the proposed antenna (not shown). The wireless ear set 1300 has two ear buds 1302 and 1304. In an embodiment, the wireless ear set 1300 may be connected with a body (not shown) and the proposed antenna may be fitted into the ear buds 1302 and 1304 or to the body itself. In another embodiment, the wireless ear set 1300 may be functional without any hardware connecting means between the ear buds 1302 and 1304. Herein, the proposed antenna may be separately fitted in the ear buds 1302 and 1304 for wireless reception and transmission. Also, the proposed antenna may be bent in such a manner so as to enclose a battery into the earbuds 1302 and 1304. Also, the proposed antenna may be rolled to fit into the structure of the earbuds 1302 and 1304. The antenna structure inside the ear buds is illustrated further in conjunction with FIG. 14 of the present invention.

Figure 14:
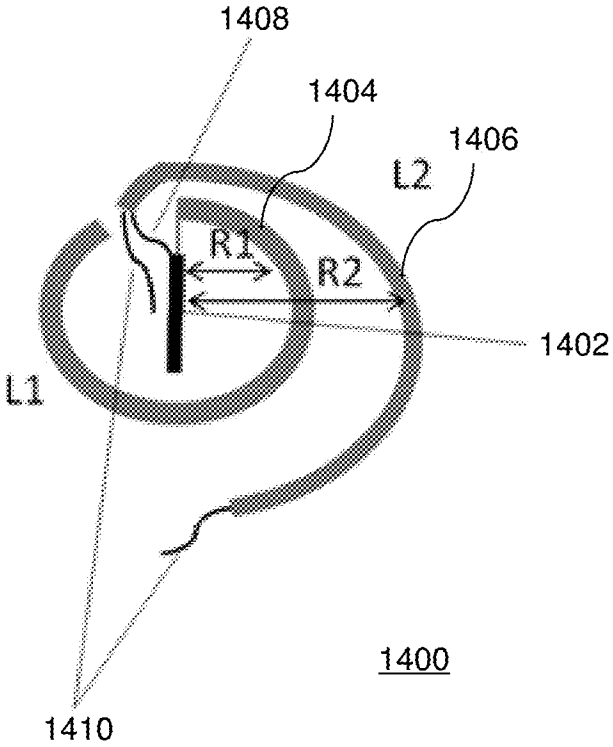
FIG. 14 illustrates a structure of a modified dipole antenna fitted inside an ear bud, in accordance with an aspect of the embodiments.
Figure 15:
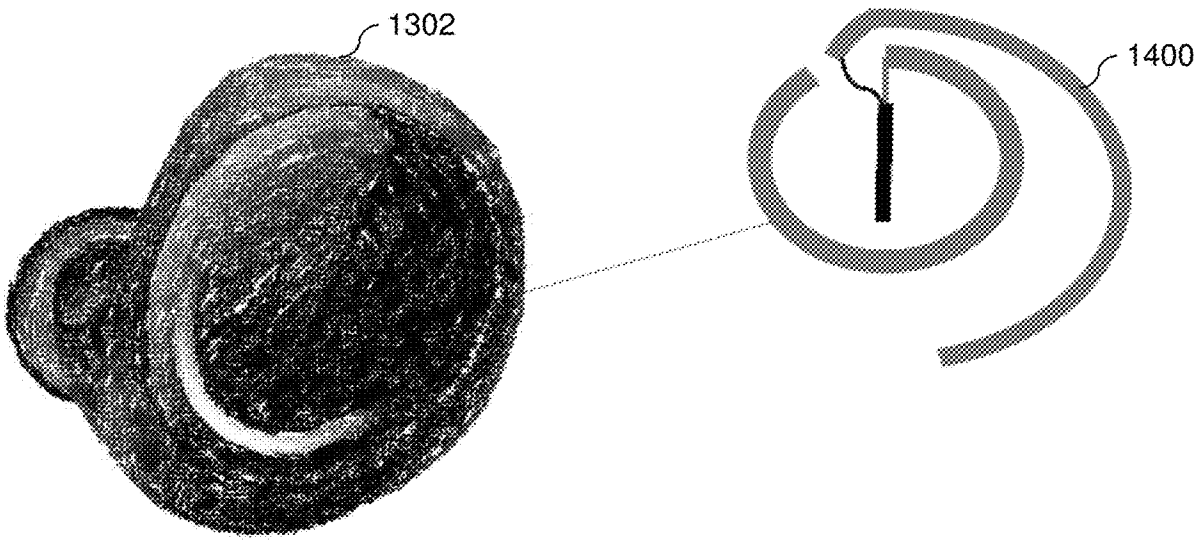
FIG. 15 illustrates structural similarity of a modified dipole antenna with an ear bud, in accordance with an aspect of the embodiments.

FIG. 14 illustrates a modified antenna 1400 for ear buds (such as ear buds 1302 as illustrated in FIG. 13). The antenna 1400 is designed to be fitted into the ear buds 1302 without compromising on wireless reception and transmission quality. FIG. 15 illustrates the position of the antenna 1400 inside the ear bud 1302. Further, as illustrated, the antenna structure comprises of a coaxial cable to wireless transceiver 1402, first metal arm 1404, second metal arm 1406, GND 1408, and signal wires 1410. The first metal arm 1404 is of L1 (arbitrary) length and the second metal arm 1406 is of L2 (arbitrary) length. Both the metal arms 1404 and 1406 may or may not have same width, depending on application requirements.

Further as illustrated, the metal arms 1404 and 1406 are kept at radial differences of R1 and R2 (arbitrary) respectively from the coaxial cable to wireless transceiver 1402 for proper radiation distribution and to improve wireless communication reception and transmission. The arms are bent into spiral shape. Values of R1 and R2 depend on the size of the ear bud and the resonance frequencies of the wireless transceiver. For better reception of the wireless signals, proposed is a formula to structure the antenna is one of the best functional modes. For example, L1/L2=l+c+w0+r0, where c is a constant and depends on the dielectric constant of the material, w0 depends on the width of pipe w & r0 depends on R1 & R2. If the antenna is place near the human body, 0<c. R is the radius of wire, and L is the length of wire.

Considerably, there are many factors affecting the transmission and reception of a normal antenna when it is attached to a human body. For example, when antenna is placed too close to the human body, it will affect the resonance frequency of the antenna and affect the matching of the antenna. Path loss can be considered as a second explanatory example. It is well known that the human body will absorb, attenuate, and reflect the RF signal.

Therefore, the proposed antenna 1400 comprises two un-equal arms of dipole (made of metal for outer layer and other substrate for inner layer e.g. air, plastic, etc.). One arm L1 or L2 (arbitrary values) is tuned for air dielectric substrate. For air, its length is about 3 cm for quarter wavelength dipole and 6 cm for half length dipole at general 2.4 GHz application. Another arm L1 or L2 (arbitrary values) is tuned closely to other substrate material such as human body. The dielectric constant of human body can be seen in FIG. 16 of the present invention. The FIG. 16 illustrates a table 1600 with right column describing dielectric constants for blood, bones, muscles, and skin of human body.

Further, the length of L1, L2 can be tuned for different frequency. Therefore, modifies the length of L1 and L2 can change the resonance frequency used by the wireless product. The diameter w will affect the ratio of L1 and L2. By using this approach, the bandwidth of the proposed antenna becomes wider. Since the resonance frequency of antenna will be shifted when it is placed near to the human body, wider bandwidth can minimize this effect.

Figure 17:
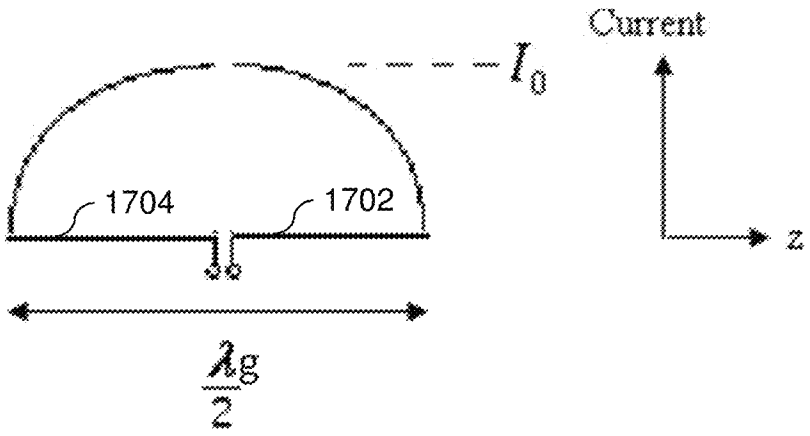
FIG. 17 illustrates a half-wavelength dipole antenna having two metal arms, in accordance with an aspect of the embodiments.

FIG. 17 illustrates a half-wavelength dipole antenna having two metal arms 1702 and 1704. The half-wavelength dipole antenna can be tuned according to different mediums such as air or body. For example, if we consider the known formula wherein speed of light (C)=frequency (fc)×wavelength (λg). Herein, by tuning λg, balance between different mediums can be achieved (e.g. air, body, etc.). In another example, if we consider length of the metal arms (L1 and L2) and width of the antenna in a pipe shape, L1/L2=l+c+$w_0$, where c is a constant and depends on the dielectric constant of the material & the $w_0$ depends on width of pipe w. If the antenna is placed near the human body, 0<c.

Based on the above examples, simulation results shows that the radiation pattern remains 360 degrees, which fulfills the objective of the proposed antenna. Further, if the proposed antenna is in pipe shape, a cylindrical hole is built inside the antenna (under inner layer of the antenna) and it is used for signal wires and let them to pass through. Also, if we consider theory, since current only travels on the metal surface, wires inside the antenna will not affect the performance of antenna too much.

Figure 18:
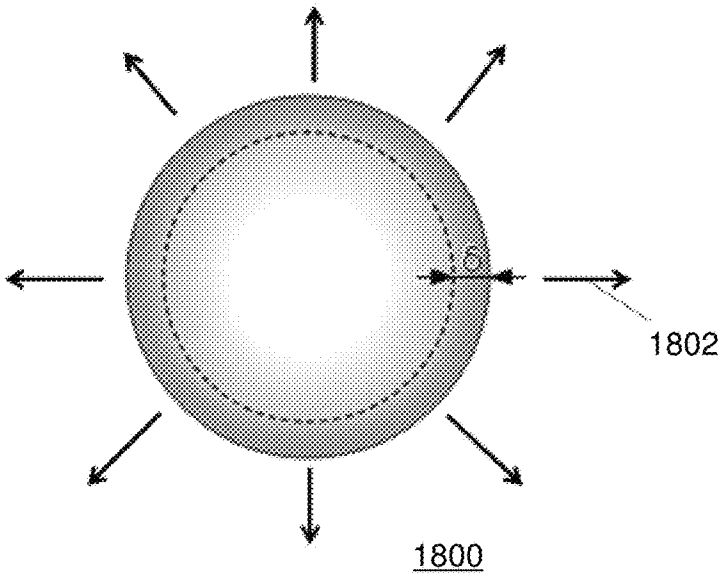
FIG. 18 illustrates a radiated signal from the modified dipole antenna, in accordance with an aspect of the embodiments.

FIG. 18 illustrates a signal 1802 radiated at the surface of antenna pipe 1800 and provides 360 degree radiation around the antenna pipe 1800. It is designed to provide a signal pattern to lower part of human body. Further, the whole antenna structure is bendable. The outer layers of the antenna arms are of metal (such as copper) and the inner layers of the arms are of non-metal materials such as air, plastic, etc. Also, the core is air and it lets wires pass through. Also, as the antenna is bendable, it can be fitted into different shape of wireless headsets.

As illustrated in FIG. 18, distribution of current flow in the cylindrical conductor is shown in cross section. For alternating current, most (63%) of the electric current flows between the surface and the skin depth, which depends on the frequency of the current and the electrical and magnetic properties of the conductor.

Figure 19:
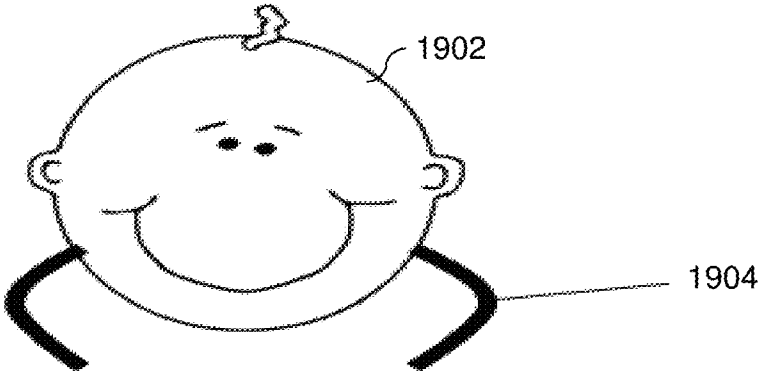
FIG. 19 illustrates a user wearing a headset comprising the modified dipole antenna, in accordance with an aspect of the embodiments.

FIG. 19 illustrates a user 1902 wearing a headset 1904 installed with the proposed antenna (not shown). In an embodiment, the headset 1904 comprises a single antenna structure and therefore may have certain drawbacks when used on human neck. The drawback may include weak signal on one side of the antenna due to attenuation via human body. Possible reasons may include length of the antenna arm at one side. To compensate, such headsets may use dual antenna structure as proposed in FIG. 9 of the present invention. Two of these antennas with symmetric or asymmetric shape can be combined together with a power divider/combiner/splitter to enhance the performance of the whole antenna.

Combination of the two proposed antennas with a power divider/splitter/combiner to form a dual antenna structure or array may minimize the signal attenuation of human body opposite to the antenna. Further, the two antennas can be symmetric or asymmetric in lengths. Also, the antenna can be fitted into two arms of the housing of the wireless headset 1902 so that the radiation pattern of the whole antenna is symmetric. Moreover, to solve the signal attenuation problem with all round radiation 360 degree patterns, dual antenna with combiner approach is used as illustrated in FIG. 9 of the present invention.

Figure 20:
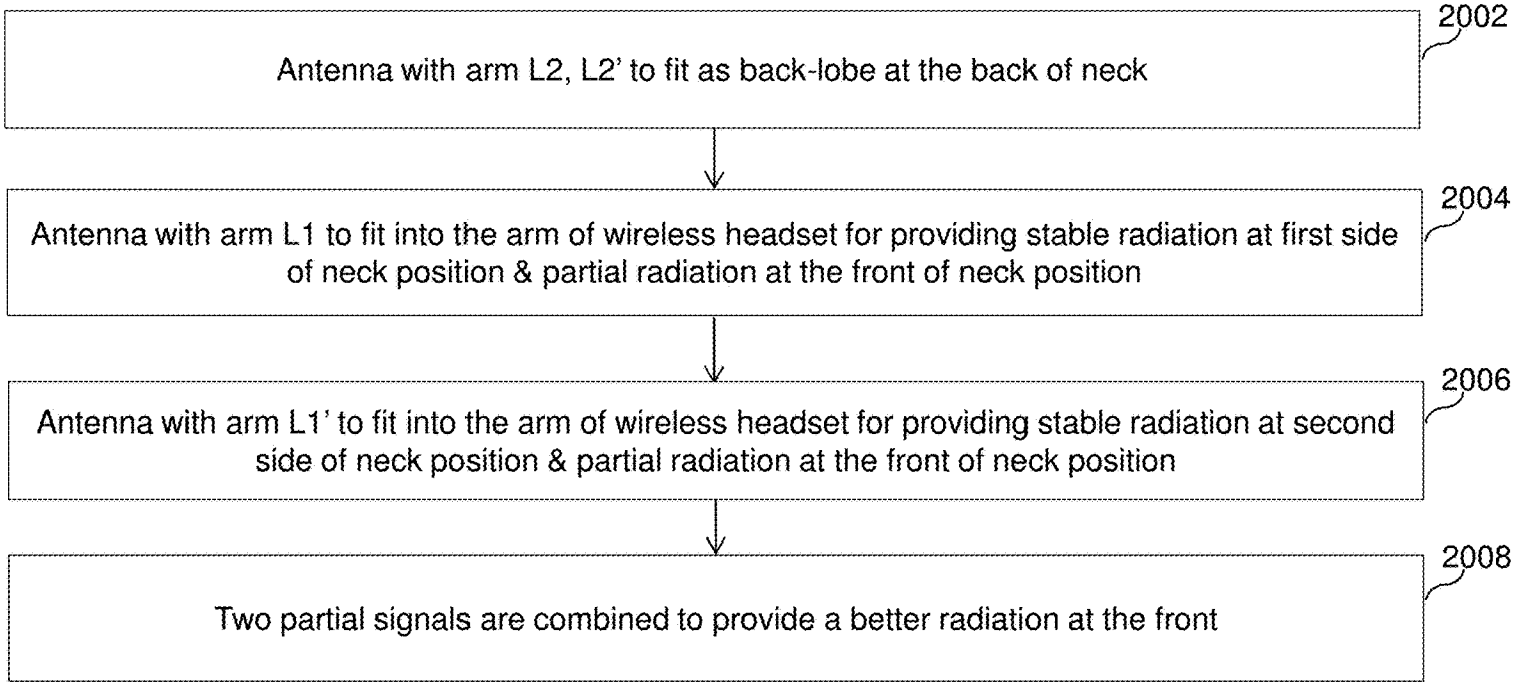
FIG. 20 illustrates a flow diagram of installing a dual antenna with combiner approach, in accordance with an aspect of the embodiments.

FIG. 20 illustrates a flow diagram of installing a dual antenna with combiner approach. At step 2002, first antenna with arm lengths L2 and L2' (arbitrary values) are fitted as back-lobe at the back of neck of a wireless headset, such as the headset illustrated in FIG. 19. Also, the antenna structure here resembles with the antenna structure discussed in conjunction with FIG. 10 of the present invention.

At step 2004, second antenna with arm length L1 (arbitrary) is fitted into an arm of the wireless headset. This provides stable radiations at first side of neck position and partial radiations at the front of the neck position. At step, 2006, the second antenna with another arm of length L1' (arbitrary) is fitted into arm of wireless headset for providing stable radiations at second side of neck position and partial radiation at the front of neck position. Thereafter, at step 2008, to complete the installation, two partial signals are combined to provide a better radiation at front of the neck position.

Figure 21A:
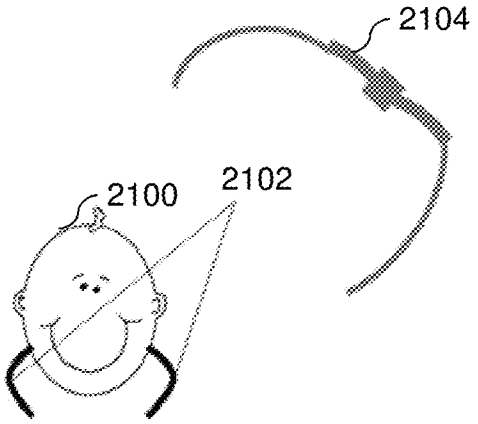
FIG. 21A illustrates a user wearing a wireless headset at neck portion, in accordance with an aspect of the embodiments.
Figure 21B:
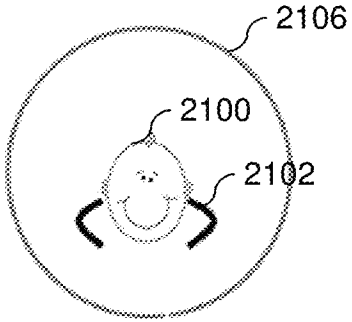
FIG. 21B illustrates a full 360 degree radiation pattern achieved by using the dual antenna approach, in accordance with an aspect of the embodiments.

FIG. 21A illustrates a user 2100 wearing a wireless headset 2102 at neck portion. The wireless headset 2102 is fitted with an antenna 2104. The antenna 2104 is a dual antenna that is explained in conjunction with FIG. 9 of the present invention. The dual antenna approach is used to provide nearly 360 degree radiation pattern 2106 around the body of the user 2100, as illustrated in FIG. 21B of the present invention. This enables efficient and lossless wireless communication via the proposed antenna structure 2104.

Further the dual antenna 2104 is a modified dipole antenna with bendable pipe shape. The bendable antenna comprises a first arm made of metal in surface layer and other arm made of a non-metal in inner layer with length L1 (arbitrary). Herein, the length is matched for the system operated frequency with first dielectric constant and the feed of the RF signal cable attached to its surface layer. Also, the second arm is made of metal in surface layer and the other arm is made of a non-metal in the inner layer with length L2 (arbitrary). Herein, the length is matched for the system operated frequency with second dielectric constant and the RF signal cable pass through the inner layer and the ground attached to its surface layer.

The ratio of L1/L2 determines the system (wireless transceiver) operation frequency varied between first dielectric constant and second dielectric constant of the substrates. The ratio is L1/L2=l+c+w0, where c is a constant & it depends on the dielectric constant of the material & the w0 depends on width of pipe w. The shape of the whole structure can be bent into different shape in order to fit into the housing of wireless product. Signal or power wires can pass through the hollow with diameter w of both arms of the antenna. The first arm can be made of metal thin wire in order to fit into the arm of the wireless headset. The first and the second arms can be separated in order to fit into the housing of the wireless headset.

Figure 22A:
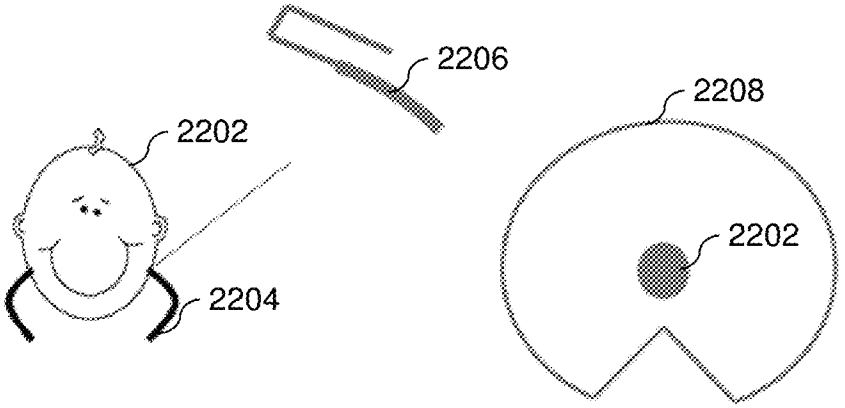
FIG. 22A illustrates a partial radiation pattern achieved via the single modified dipole antenna in presence of a human body, in accordance with an aspect of the embodiments.

FIG. 22A illustrates a user 2202 wearing a wireless headset 2204 installed with a modified dipole antenna 2206 that is bent in a specific manner and is already discussed in conjunction with FIG. 6A of the present invention. The bent structure of the antenna causes the radiation pattern 2208 and is derived from lab testing. As illustrated clearly, the radiation pattern is not a full 360 degree and is weaker in front portion. Therefore, another dual antenna approach is illustrated in FIG. 22B to achieve a full 360 degree radiation pattern around the user 2202 for better and efficient signal reception and transmission.

Figure 22B:
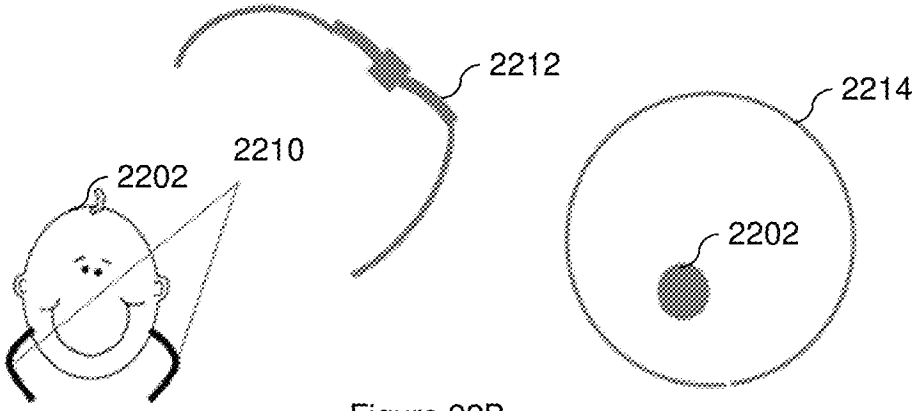
FIG. 22B illustrates a full radiation pattern achieved via the dual antenna approach in presence of a human body, in accordance with an aspect of the embodiments.
Figure 23:
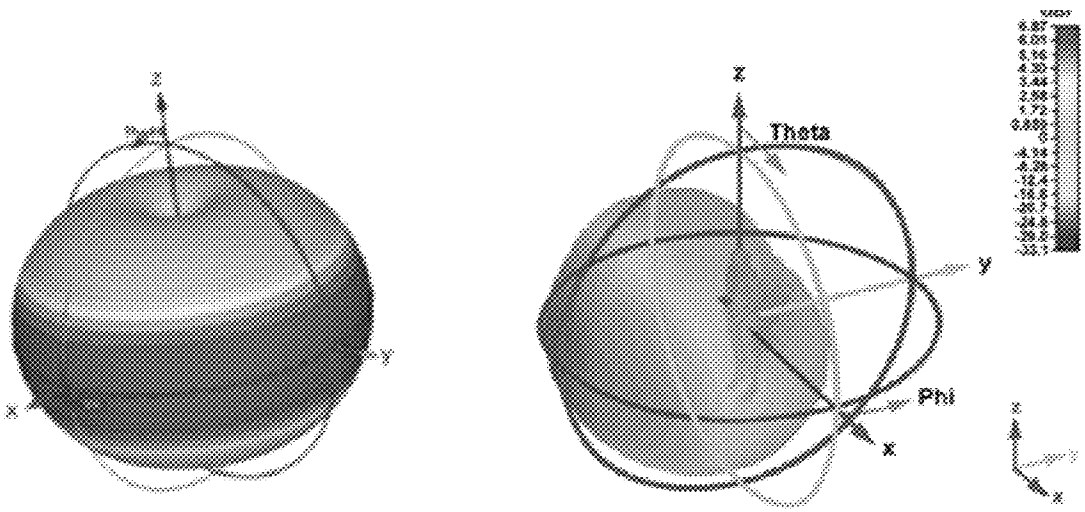
FIG. 23 illustrates lab radiation results formed by the modified dipole antenna, in accordance with an aspect of the embodiments.

FIG. 22B illustrates a user 2202 wearing a wireless headset 2210 that is installed with a modified dipole antenna 2212 and is a combination of two modified dipole antennas connected by a power splitter, as already discussed in conjunction with FIG. 9 of the present invention. The dual antenna structure of the antenna 2212 causes the radiation pattern 2214 and is derived from lab testing. As illustrated clearly, the radiation pattern is nearly a full 360 degree and therefore achievable even in presence of human body. Similar experimentation results are further illustrated in FIG. 23 of the present invention, wherein nearly a full 360 degree radiation pattern is achieved even in presence of a human body. However, it is to be noted that the design considerations in FIG. 23 is illustrated for indoor wireless transmission between a body-worn physiological monitoring device and a gateway in a home environment.

FIG. 24 illustrates a comparison chart 2402 wherein advantages (marked with good icon) and disadvantages (marked with bad icon) are compared with the proposed antenna structure. Clearly, the proposed antenna structure has the advantage of providing a full 360 degree field pattern, is able to mount wires, and is bendable to fit in any product size and shape. The comparison chart is used to compare with traditional antennas only. Further, as the proposed antenna is a modified dipole structure, it is also evident from the comparison chart that the modifications in the dipole antenna helped the proposed antenna in overcoming the only disadvantage of the dipole antenna of getting affected by the human body. In addition, the proposed antenna improved the dipole antenna to further provide the advantage of being able to mount wires, which was not possible with the dipole antenna alone.

The order in which the method is described is not intended to be construed as a limitation, and any number of the described method blocks can be combined in any order to implement the method or alternate methods. Additionally, individual blocks may be deleted from the method without departing from the spirit and scope of the subject matter described herein. Furthermore, the method can be implemented in any suitable hardware, software, firmware, or combination thereof. However, for ease of explanation, in the embodiments described below, the method may be considered to be implemented in the above described system and/or the apparatus and/or any electronic device (not shown).

The above description does not provide specific details of manufacture or design of the various components. Those skills in the art would be familiar with such details, and unless departures from those techniques are set out, techniques, known, related art or later developed designs and materials should be employed. Those in the art are capable of choosing suitable manufacturing and design details.

Note that throughout the following discussion, numerous references may be made regarding servers, services, engines, modules, interfaces, portals, platforms, or other systems formed from computing devices. It should be appreciated that the use of such terms is deemed to represent one or more computing devices having at least one processor configured to or programmed to execute software instructions stored on a computer readable tangible, non-transitory medium or also referred to as a processor-readable medium. For example, a server can include one or more computers operating as a web server, database server, or other type of computer server in a manner to fulfill described roles, responsibilities, or functions. Within the context of this document, the disclosed devices or systems are also deemed to comprise computing devices having a processor and a non-transitory memory storing instructions executable by the processor that cause the device to control, manage, or otherwise manipulate the features of the devices or systems.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "generating," or "monitoring," or "displaying," or "tracking," or "identifying," "or receiving," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The methods illustrated throughout the specification, may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

The terminology used herein is for the purpose of describing particular embodiments only and is not intended to be limiting of the disclosure. It will be appreciated that several of the above-disclosed and other features and functions, or alternatives thereof, may be combined into other systems or applications. Various presently unforeseen or unanticipated alternatives, modifications, variations, or improvements therein may subsequently be made by those skilled in the art without departing from the scope of the present disclosure as encompassed by the following claims.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A modified dipole antenna comprising:

a first arm having a surface layer made of a metal and an inner layer made of a non-metal, wherein a feed of a radio frequency signal cable is attached to the surface layer of the first arm; and a second arm having a surface layer made of a metal and an inner layer made of a non-metal, wherein the radio frequency signal cable is passed through the inner layer of the second arm and ground is attached to the surface layer of the second arm, wherein length of the first arm is determined from a first dielectric constant of a first dielectric material and length of the second arm is determined from a second dielectric constant of a second dielectric material;

wherein the first arm and the second arm is bent in a spiral shape forming different radii of the first arm and the second arm and wherein the radii of the first arm and the second arm are dependent on resonance frequencies of the wireless transceiver.

2. The modified dipole antenna of claim 1, wherein the first dielectric material is air and the second dielectric material is human body.

3. The modified dipole antenna of claim 1, wherein the modified dipole antenna is bendable.

4. The modified dipole antenna of claim 1, wherein the modified dipole antenna is fitted into a cylindrical pipe shape that is bendable for fitting into a wireless electronic apparatus.

5. The modified dipole antenna of claim 1, wherein the wireless electronic apparatus is a headset worn by a human body.

6. The modified dipole antenna of claim 1, wherein the first and second dielectric constants are different.

7. The modified dipole antenna of claim 1, wherein a wireless transceiver operated frequency is determined by ratio of the lengths of the first arm and the second arm.

8. The modified dipole antenna of claim 7, wherein the wireless transceiver operated frequency is dependent on the first dielectric constant, the second dielectric constant, and width of the modified dipole antenna that is fitted into a cylindrical shape body.

9. The modified dipole antenna of claim 1, wherein the length of the first arm is tuned as per dielectric constant of air.

10. The modified dipole antenna of claim 9, wherein the length of the first arm is 3 cm for quarter wavelength dipole and 6 cm for half wavelength dipole operating at 2.4 GHz.

11. The modified dipole antenna of claim 1, wherein the length of the second arm is tuned according to dielectric constant of human body.

12. The modified dipole antenna of claim 1, wherein the lengths of the first and second arms are differently tuned for widening bandwidth of the modified dipole antenna to further minimize radiation disturbance caused by presence of a human body.

13. The modified dipole antenna of claim 1, wherein width of at least one of the first arm and the second arm is comparatively thinner than the other.

14. The modified dipole antenna of claim 1, wherein the first and the second arms are designed to be detachable from the modified dipole antenna.

15. The modified dipole antenna of claim 1, wherein the modified dipole antenna is combined together with a power divider, and the power divider is further connected with a second modified dipole antenna for enhancing collaborative performance.

16. The modified dipole antenna of claim 15, wherein the second modified dipole antenna is similar to the modified dipole antenna and comprises symmetric arm lengths.

17. The modified dipole antenna of claim 15, wherein the second modified dipole antenna is similar to the modified dipole antenna and comprises asymmetric arm lengths.

18. The modified dipole antenna of claim 15, wherein partial radiation patterns of the modified dipole antenna and the second modified dipole antenna are combined to provide a full 360 degree radiation pattern.

19. The modified dipole antenna of claim 15, wherein partial radiation patterns of the modified dipole antenna and the second modified dipole antenna minimizes signal attenuation caused due to presence of a human body in proximity.

* * * * *